United States Patent [19]

Donachie

[11] 4,049,429

[45] Sept. 20, 1977

[54] FERRITIC ALLOYS OF LOW FLOW STRESS FOR P/M FORGINGS

[75] Inventor: Stephen James Donachie, New Windsor, N.Y.

[73] Assignee: The International Nickel Company, Inc., New York, N.Y.

[21] Appl. No.: 448,883

[22] Filed: Mar. 7, 1974

Related U.S. Application Data

[62] Division of Ser. No. 345,981, March 29, 1973, Pat. No. 3,864,809.

[51] Int. Cl.[2] ..... C22C 33/02

[52] U.S. Cl. ..... 75/246; 75/123 J; 75/123 K; 75/123 L; 75/125; 75/950

[58] Field of Search ..... 29/182; 75/123 K, 123 B, 75/123 J, 125, 128 F, 128 R, 128 W

[56] References Cited

U.S. PATENT DOCUMENTS

| | | | |
|---|---|---|---|
| 3,067,032 | 12/1962 | Reed | 29/182 |
| 3,110,635 | 11/1963 | Gulya | 75/123 K |
| 3,303,061 | 2/1967 | Wilson | 75/125 X |
| 3,471,343 | 10/1969 | Koehler | 29/182 |
| 3,655,366 | 4/1972 | De Paul | 75/123 J |
| 3,827,863 | 8/1974 | Takahashi et al. | 29/182 |
| 3,856,478 | 12/1974 | Iwata et al. | 29/182 |

*Primary Examiner*—Richard E. Schafer

*Attorney, Agent, or Firm*—Raymond J. Kenny; Ewan C. MacQueen

[57] ABSTRACT

Ferritic age-hardenable alloy steels containing correlated percentages of nickel, copper, molybdenum, carbon, etc. in powder form are characterized by low flow stress, thus rendering them particularly suitable for P/M hot forging.

6 Claims, 1 Drawing Figure

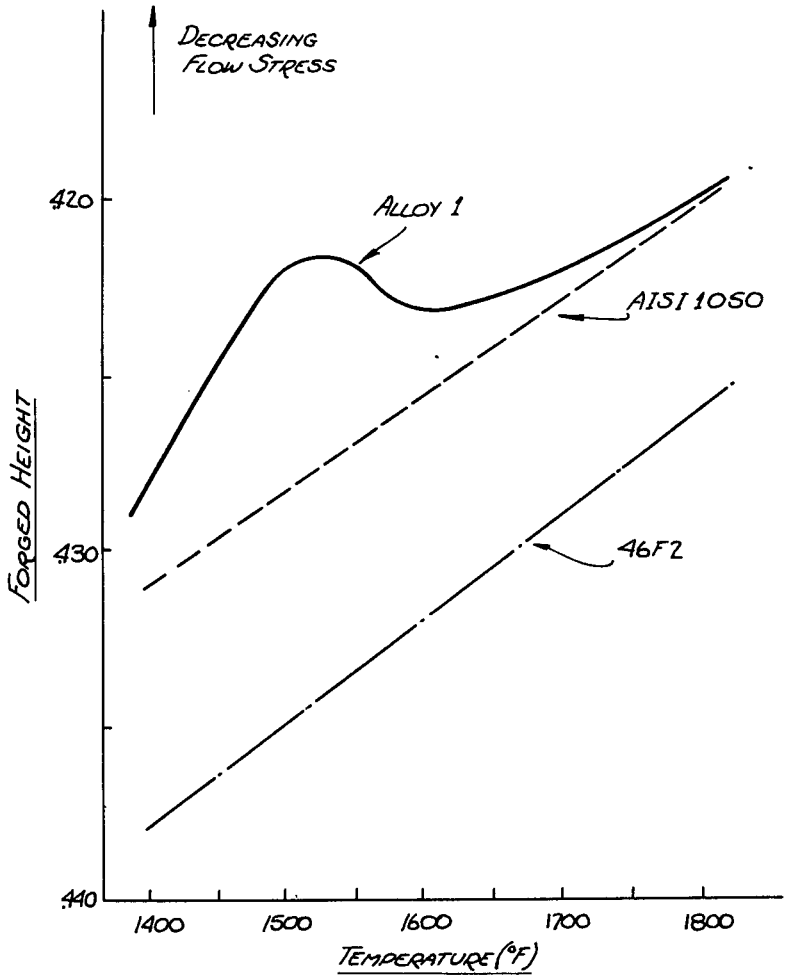
DECREASING
FLOW STRESS
ALLOY 1
AISI 1050
46F2
FORGED HEIGHT
.420
.430
.440
1400
1500
1600
1700
1800
TEMPERATURE (°F)

FERRITIC ALLOYS OF LOW FLOW STRESS FOR P/M FORGINGS

This is a division of application Ser. No. 345,981 filed Mar. 29, 1973 now U.S. Pat. No. 3,864,809.

The subject invention is addressed principally to powder metallurgy hot forging of novel steels.

As a review of the literature would confirm, powder metallurgy (often herein "P/M") has continued to assume a more prominent position in many areas as a viable alternative to conventional melting-casting-working processing. This has been notably evident in respect of applications where the risks inherent in the uncertainties of segregation problems could not be entertained and, of course, in respect of those applications involving the production of intricately shaped components.

However, though the attributes of powder metallurgy are many, this unique tool has not escaped problem-free. As is known, powders are normally compacted and sintered in the conventional sequence of operations leading to a finished article. As a consequence, there is often encountered the attendant and inherent difficulties associated with "porosity". Porosity simply means voids in the metal produced. As such, the voids can act in similar fashion to internal notches. By reason of this, inter alia, conventionally produced P/M steels have hardly been known for their capacity to absorb much by way of impact energy, let along significant levels thereof. Nor have they been known for an ability to resist fatigue stress. And it is axiomatic that porosity detracts from strength. Accordingly, the lack of such properties, toughness, fatigue life and yield and ultimate tensile strengths, has hampered the overall growth of P/M.

Techniques such as hot consolidation, repressing and/or infiltration, etc., have served to mitigate the porosity dilemma. But they are rather costly and usually not amenable to mass production, decided drawbacks. In recent years P/M hot forging has been resurrected, so to speak, since it offers a potential panacea to the porosity phenomenon while being responsive to automation. Here, however, initial die cost, short die life and operational down time for die replacement all combine to equal "high die cost". Too, prior art steels have suffered from an inability to "fill" complex dies requiring large amounts of metal flow, e.g., those used for automotive connecting rods.

Now, it appears to be generally acknowledged that lower forging pressures and/or temperatures would result in decreased die wear. In this connection, it has been reported [1] that a decrease in forging pressure from 70 tsi to 30 tsi would improve die life 150%. Unfortunately, density drops 1.5% and at these levels impact resistance is related exponentially to density. The result—enhanced die life at the drastic impairment of impact toughness, and fatigue resistance as well. This is most troublesome for most P/M hot forged parts envisaged to date would be exposed to cyclic or axial stress and impact loading, fatigue and toughness thus being of utmost importance. [1] "Hot Forging P/M Relationships Between Manufacturing Design, and Component Cost", T. W. Pietrocini, Society of Manufacturing Engineers, Technical Paper EN 71-260.

In any case, it has now been discovered that certain ferritic steel compositions containing correlated percentages of nickel, copper, molybdenum, carbon, etc., can be forged at most dramatically reduced pressures and/or temperatures. It is considered that the flow stress of certain of such steels is so low as to be the virtual equivalent of "pure iron" at corresponding forging temperatures. These characteristics greatly promote improved die filling and bring about reduced die wear, lending to significant economic benefits.

Furthermore, in accordance herewith Charpy V-notch (CVN) impact values of up to 70 ft. lbs. (room temperature) and fatigue limits of nearly 70% of the ultimate tensile strength have been achieved. These values obtain for steel compositions having yield and ultimate tensile strengths on the order of about 90,000–100,000 and 110,000–150,000 psi, respectively, i.e., steels of intermediate strength. (The instant steels are not to be considered as "high strength" steels, i.e., steels having yield strengths above about 125,000–150,000 psi.) Insofar as I am aware, typical impact and fatigue strengths of conventionally produced P/M steels forged at the same loads are generally on the order of about 5 to less than 25 ft. lbs. and 40% of ultimate tensile strength, respectively, at the comparable strength levels. It is considered that the high internal cleanliness of the microstructures of the instant steels, particularly a low oxygen content, lends to these qualities.

Generally speaking, the present invention contemplates the hot forging of age-hardenable ferritic steel powders which most advantageously contain about 0.7% to 1% or 1.25% nickel, about 1.4% to 2% or 2.25% copper, about 0.15% to 0.35% molybdenum, up to 0.02% carbon, up to 0.05% or 0.1% silicon (if any), up to 0.15% manganese, the balance being essentially iron. Forging temperatures as low as 1300° F. can be used, yet the densities of the Forgings produced are at "full density" without recourse to excessive pressures.

In carrying the invention into practice, a proper balance in chemistry must be struck to assure obtaining a ferritic (body-centered-cubic) structure. In addition, the alloying constituents should be correlated such that the $Ac_1$ critical temperature of the steels afford a substantially, if not completely, ferritic structure up to a temperature of 1400° F. and most preferably to 1550° F., this to minimize the presence of the face-centered-cubic austenite. The presence of austenite is not only unnecessary but undesirable since it impedes flow stress. It should preferably not exceed 2 or 3% by volume, although higher percentages might be tolerated, say up to less than 10% or possibly in some instances up to 20%. Moreover, the alloying constituents should be balanced such that solid solution strengthening is maintained to a minimum during forging. Solid solution strengthening effects offset low flow stress. The foregoing alloying ranges are designed to achieve these characteristics. However, departures therefrom can be made using the following guides.

Nickel is an austenite former, lowers $Ac_1$, contributes to aged tensile strength and impact energy and while it can be as high as 1.5%, such higher percentages tend to unnecessarily decrease $Ac_1$ and this renders it more difficult to achieve the desired ferritic structure and lower flow stresses. The nickel level can extend down to 0.4% or 0.25%, but at the sacrifice of toughness and strength.

With regard to the element copper, it has but a moderate detracting influence with respect to the $Ac_1$ temperature. Its main role is of imparting strength through precipitation hardening, although it does not appreciably contribute to solid solution strengthening during forging. The copper content can be as low as about 0.75%, but in striving for optimum results it should be at least 1.5%. Not much is gained by copper percentages above 2 or 2.25%. A range of 1.5 to 1.8% is very beneficial.

Molybdenum enhances the intensity of the copper age hardening reaction and raises the critical temperatures; however, it should not exceed 0.6%. High levels can introduce a solid solution strengthening problem during forging at low temperatures. I have found, for example, that an amount of molybdenum slightly above 1% did significantly increase tensile strength. But this solid solution hardening was achieved at the expense of flow stress and impact strength. And on balance the gain in strength neither warranted the increase in flow stress nor the loss of impact resistance. Molybdenum is also deemed to resist embrittlement. A range of 0.1 to 0.4% is satisfactory with a range of about 0.15 or 0.2% to 0.25% or 0.3% being considered the most advantageous.

The subject steels are of the low carbon type even to the point of being carbon-free. Carbon confers strength, but at the same time raises flow stress and it is deemed that the fatique ratio (ratio of fatigue limit to tensile strength) is also needlessly decreased as well as the ability of the steels to absorb impact energy. For special purposes where relatively poor properties would be acceptable, carbon up to 0.1% might be tolerated in a carefully balanced alloy, but as a practical matter it should not exceed 0.03 to 0.05%. It is difficult to avoid the presence of carbon altogether, but notwithstanding this an upper level of 0.02% should be maintained.

As to the other constituents, the use of scrap stock in a melt charge would likely introduce manganese and also silicon. An increase in manganese results in higher levels of strength in the aged condition, but flow stress is also raised particularly if lesser amounts of other austenite stabilizing elements are not used. Moreover, manganese above 0.1 or 0.2% increases the oxide content and this should be avoided since oxides subvert toughness and fatigue characteristics. A manganese percentage of 0.5% can be tolerated where optimum results are not sought.

Silicon is a ferrite stabilizer and contributes to strength through solid solution hardening. It is a strong oxide former and detracts from toughness. Thus, it should be held to impurity levels, if any. Up to 0.3% can probably be tolerated where a lesser combination of properties can be accepted. Even here it should be held to less than 0.2% if at all possible.

Where scrap is used in a charge, up to 0.1% chromium could be present. However, while chromium is effective in raising the critical temperature of the steels contemplated, it is a very stable oxide former and for this reason it should be avoided. Where alloy cleanliness and other properties can be traded off for strength, then up to 0.3 or 0.5% can be tolerated.

Small amounts of boron can be employed, though it need not exceed 0.02 or 0.01%. Aluminum is unnecessary and should be controlled to a minimum, say 0.1% or lower. Phosphorus and sulfur should be held to not more than 0.04%, preferably to not more than 0.02%, each. Oxygen will be present and should be maintained, for reasons given above, to not more than 0.06%, and most advantageously to not more than 0.02%.

Concerning the powder particles, while elemental powders might be blended and sintered to the desired composition, it is deemed preferable to use prealloyed powder. This can be accomplished through atomization in which a liquid melt is converted to powder by using air, inert gas, water, etc., to bring about atomization. Water atomization is considered appropriate since it is commonly employed, is relatively inexpensive, and provides particles of irregular shape. Prealloying and atomization also provide for small particle size and grain size. The alloy powders should not exceed about 500 or 600 microns (including oxide film), preferably being less than 250–300 microns.

The prealloyed powder particles are thereafter compacted to a preform, the shape of which will be often governed by the shape of the final product. Thereupon, the preform is heated to obtain the desired ferritic structure whereupon it is forged to shape and to full or nearly full density. As is rather conventional, an appropriate lubricant can be added to the powder before pressing to the preform. Also, the preform can, indeed should, be heated (sintered) prior to forging in accordance with usual practice. Subsequently, the product may, if desired and depending on composition, be further processed, e.g., machined, prior to aging. Steels in accordance herewith should be aged at about 900° to 1050° F., e.g., 925° to 1000° F., for about 1 to 5 hours. Above about 1000° F. the alloys tend to overage, i.e., lose strength and gain in toughness.

In order to give those skilled in the art a better appreciation of the invention, the following is given.

Various steels, A, 1 and B in Table I, were prepared using electrolytic iron, nickel shot, ferromolybdenum (60% Mo) and copper shot. The melt procedure involved forming an initial charge (45 kg) of iron, nickel and copper, heating to 3000° F., adding the ferromolybdenum, and pouring at 3000° F. into a heated tundish. The molten steel was water atomized at the bottom orifice of the tundish, the powder thereafter being dried and reduced at 1800° F. (to obtain a good oxygen reduction) in a cracked ammonia atmosphere (dewpoint about minus 50° F.). The powder was pulverized and heated for 1 hour at 1400° F. (to remove strain from pulverization) under a cracked ammonia atmosphere.

The powders were admixed with a lubricant before compaction, in this case 0.5% by weight of Acrawax. The powders were blended with carbon, poured into a die and compressed cold. These green compacts were heated to 1200° F. in cracked ammonia to dispel the Acrawax and cooled to ambient temperature. They were reheated to 2050° F., again in cracked ammonia, and held thereat for one-half hour to effect sintering (approximately 6.79 gm/cm$^3$ density).

To assess flow stress, a hot compression test was used. Specimens about ½ inch diameter and 1 inch in height were heated to 1450° F. and a force was applied until the specimen height was reduced 0.2 inch, a 20% reduction.

The results are recorded in Table I, crystal structure also being given. Included for comparison is a composition responding to AISI 4620 (0.25% carbon added to the blend).

TABLE 1

| Alloy No. | Ni % | Cu % | Mo % | C % | Mn % | O % | Crystal Structure | Force at 20% Compression lbs. |
|---|---|---|---|---|---|---|---|---|
| AISI 4620 | 1.9 | n.a. | 0.25 | 0.25* | 0.11 | — | Austenite & Ferrite | 3400 |
| A | 1.9 | 1.8 | 1.2 | 0.07 | 0.05 | — | Ferrite | 4050 |
| 1 | 0.95 | 1.9 | 0.3 | 0.012 | 0.04 | 0.016 | Ferrite | 2550 |
| B | 0.95 | 1.9 | 0.3 | 0.1* | 0.04 | — | Austenite & Ferrite | 3100 |

*addec; n.a. = not added; Silicon <0.01 in all alloys

In respect of the above data, the compressive forming load required for AISI 4620 was relatively high, largely by reason of excessive austenite. Alloy A shows that obtaining a ferrite structure per se is not necessarily an answer. In this particular instance the high molybdenum content introduced excessive solid solution strengthening. This is in marked contrast with Alloy 1, an alloy within the invention. It will also be observed that compressive forming for AISI 4620 was approximately 33⅓% higher than for Alloy 1. This most significant advantage can be largely lost, for example, by the presence of a comparatively high carbon level as evident from Alloy B.

Mechanical properties were determined in respect of Alloys A and 1. In this connection, a preform specimen approximately 2½ inches × 0.4 inch × 0.75 inch was prepared and heated to forging temperature (1450° F.) and placed in a confined, limiting flash die and forged at a force of 70 tons. This produced a finished article approximately 2 inches × ½ inch × ½ inch. Both alloys were subjected to tensile and impact testing with Alloy 1 also undergoing an axial fatigue evaluation. Prior to test, the alloys were age hardened by heating to 950° F. and holding for 4 hours. Alloy 1 was also tested after 5 hours at 1000° F. The fatigue evaluation (Alloy 1 at 950° F. for 4 hours) involved a more severe test than the conventional tension-tension determination. In this regard, complete reversal loading was employed (push-pull test) in which a cylindrical specimen was axially loaded along its longitudinal axis.

TABLE II

| Alloy No. | Y.S., psi | UTS psi | EL. % | RA. % | CVN* ft. lbs. | Fatigue Limit, psi |
|---|---|---|---|---|---|---|
| A | 116,000 | 132,000 | 18 | 58 | 15 | — |
| 1** | 103,000 | 105,000 | 24 | 73 | 70 | — |
| 1 | 103,000 | 105,000 | 27 | 64.5 | — | 70,000 |

*70° F.;
**heated 5 hr./1000° F.

Concerning the mechanical properties reported in Table II, particular note should be taken of the outstanding impact and fatigue values.

In further confirming the effect of low flow stress characteristics on density characteristics of alloys within the invention, particularly the comparison with rather typical current commercial P/M forgings, Alloys A and 1 were similarly processed as above except a forging force of 30 tons was employed. A steel designated 46F2, 0.3% carbon added, was similarly processed as were (a) an AISI 4600 type steel with a 0.3% carbon addition, (b) AISI 1050 (Fe + 0.5 C) and Alloy A.

Against a theoretical maximum density of 7.84 – 7.86, Alloy 1 had a density of 7.78 at 1500° F. versus only 7.55, 7.58, and 7.63 for the 46F2, 4600 and Alloy A steels, respectively. AISI 1050 manifested a density of 7.69 which is higher than the other three, but it is a steel very poor in terms of mechanical properties. It is to be understood that these densities are not the best that could be achieved. As will be appreciated by those skilled in the art, the 30 ton force (somewhat low) was deliberately selected so as to determine the ease by which full density, if possible, could be reached.

Preform specimens of Alloy 1 and 46F2 and AISI 1050 steels were also forged over a range of temperature to estimate expected flow stress behavior. The results are depicted in FIG. 1 in which it can be seen that the expected flow stress of Alloy 1 is extremely low, optimum being at about 1450°–1550° F. It might be mentioned that a flash die was used since the flash formed is free to expand such that the lower flow stress materials show a greater amount of flash, thus producing a smaller forged height.

Apart from the many advantages of the instant steels as above discussed, it might also be mentioned that owing to the unusually low flow stresses threof, hot forgings having large surface areas or which require large forging strains can now be forged at pressures capable of being delivered by available equipment. New capital investment will not be required. Simplified preform design is another asset. For example, present internal combustion engine connection rod configurations are so complicated that only a simple repressing can be accomplished. Furthermore, even conventional quenching and tempering is obviated and since minimum machining is one of the principal economic advantages of hot forging preforms, no machining is required to correct quenched induced distortion, an otherwise severe drawback. This provides for retention of closer part tolerances.

Moreover, the low oxygen content and clean structures greatly contribute to the overall combination of properties. Simply heating, e.g., sintering at 1900° to 2100° F. in dissociated ammonia or equivalent is all that is required. Because the concentration of strong oxide formers is low in the subject steels, such a treatment results in very low oxygen contents, e.g., 0.01 or 0.02% and less. Of course, the oxygen content is low prior to the burn-off treatment, e.g., 0.2% or less due to initial low oxide content. Fatigue and impact resistance particularly benefit from such low oxygen clean forged structures. Such factors enable the steels to compete as a structural material at the given strength levels.

While the present invention is useful in the production of a wide variety of forged parts, it is deemed particularly applicable to the production of connecting rods, gearing, pinions and the like.

Although the invention has been described in conjunction with preferred embodiments, modifications can be resorted to. Apart from powder forging, the alloy powders can be extruded or otherwise worked. Compositions within the invention have been prepared by melting-casting-working procedures and exhibit useful properties for mill products though their structures are not as clean and they contain higher oxygen levels. Such modifications are within the overall purview of the invention.

I claim:

1. A consolidated age-hardenable powder metallurgical alloy steel in the ferritic condition particularly adapted for PM/hot forging and characterized by (a) low flow stress, (b) good impact strength, (c) high resistance to fatigue and (d) good flowability such as to fill complex dies, said steel being formed from about 0.7% to about 1% nickel, 1.4% to 2% copper, 0.15% to 0.35% molybdenum, up to 0.02% carbon, up to 0.1% silicon, up to 0.15% manganese, and the balance essentially iron.

2. A P/M steel in accordance with claim 1 in which the copper is from 1.5% to 1.8% and the molybdenum is from about 0.2% to about 0.3%.

3. A P/M steel in accordance with claim 1 in which oxygen does not exceed 0.03%, silicon is less than 0.05% and manganese does not exceed 0.1%.

4. A connecting rod forged from the steel of claim 1.

5. A gear forged from the steel of claim 1.

6. A consolidated age-hardenable powder metallurgical steel in the ferritic condition particularly adapted for PM/hot forging, said steel having from 0.7 to 1.25% nickel, from 0.75% to 2.25% copper, from 0.1 to 0.4% molybdenum, up to 0.2% silicon, up to 0.2% manganese, up to 0.03% carbon and the balance essentially iron.

* * * * *